US009364892B2

(12) United States Patent
Yoo et al.

(10) Patent No.: US 9,364,892 B2
(45) Date of Patent: Jun. 14, 2016

(54) CENTRIFUGAL CASTING MACHINE FOR MANUFACTURING ROTOR

(71) Applicant: HYUNDAI HEAVY INDUSTRIES CO., LTD., Ulsan (KR)

(72) Inventors: Ji-Hoon Yoo, Gyeongsangbuk-do (KR); Kwang-Jin Han, Ulsan (KR); Sung-Mo Lee, Ulsan (KR); Byoung-Hun Kwon, Ulsan (KR); Deok-Su Kim, Ulsan (KR)

(73) Assignee: HYUNDAI HEAVY INDUSTRIES CO., LTD., Ulsan (KR)

( * ) Notice: Subject to any disclaimer, the term of this patent is extended or adjusted under 35 U.S.C. 154(b) by 0 days.

(21) Appl. No.: 14/477,325

(22) Filed: Sep. 4, 2014

(65) Prior Publication Data

US 2015/0068699 A1 Mar. 12, 2015

(30) Foreign Application Priority Data

Sep. 6, 2013 (KR) ..... 10-2013-0107218

(51) Int. Cl.
*B22D 13/04* (2006.01)
*B22D 13/10* (2006.01)

(52) U.S. Cl.
CPC ..... *B22D 13/04* (2013.01); *B22D 13/101* (2013.01); *B22D 13/104* (2013.01)

(58) Field of Classification Search
CPC ..... B22D 13/04; B22D 13/10; B22D 13/101; B22D 13/104
USPC ..... 164/286, 296
See application file for complete search history.

(56) References Cited

U.S. PATENT DOCUMENTS 2,996,773 A * 8/1961 Summers ..... B22D 19/0054 164/109
5,467,521 A * 11/1995 Nakamura ..... H02K 15/0012 164/109
2014/0097720 A1* 4/2014 Thieman ..... H02K 15/0012 310/211

FOREIGN PATENT DOCUMENTS

KR 10-2011-0098020 A 9/2011

* cited by examiner

*Primary Examiner* — Kevin P Kerns
(74) *Attorney, Agent, or Firm* — Rabin & Berdo, P.C.

(57) ABSTRACT

Disclosed herein is a centrifugal casting machine, including: a rotating plate rotating by means of a motor; a cylindrical sleeve installed on the rotating plate and having an internal diameter corresponding to an external diameter of silicon steel plates constituting a core in the sleeve; an upper mold internally installed on the sleeve to define a first molding space into which a molten metal is introduced to mold an end ring; a lower mold internally installed on the sleeve to define a second molding space into which a molten metal is introduced to mold an end ring; a dummy shaft fitted in the center of the core and coupled to the lower mold; a cap coupled to an upper end of the dummy shaft to press the core; and a hydraulic ram coupled to the lower mold to move the lower mold up and down and coupled to the rotating plate to rotate therewith.

5 Claims, 3 Drawing Sheets

CENTRIFUGAL CASTING MACHINE FOR MANUFACTURING ROTOR

BACKGROUND OF THE INVENTION

1. Field of the Invention

The present invention relates to a centrifugal casting machine for manufacturing rotors, which are used in rotating appliances such as an electric motor and an electric generators, and more particularly to a centrifugal casting machine in which a lower mold applies a consistent pressure to a core to cause silicon steel plates constituting a core to be in close contact with each other during a centrifugal casting of rotors and in which the lower mold is movable up and down by means of a hydraulic ram to allow cast products to be easily taken out after the centrifugal casting operation.

2. Description of the Related Art

A rotating appliance such as an electric motor and an electric generator include a rotor and a stator as its substantial parts, in which the rotor is disposed at the center of the rotating appliance and the stator is installed in the rotating appliance to surround the rotor.

The rotor is composed of a plurality of stacked silicon steel plates which in turn constitute a core. The core is provided at upper and lower ends with end rings, and the upper and lower end rings are coupled to each other by means of a plurality of bars penetrating the core.

In order to manufacture such a rotor, a molten metal is vertically introduced from an upper end or a lower end of a mold to the opposite lower end or upper end thus molding an end ring, a core and a bar in a conventional technology. However, according to the conventional technology, cast defects are apt to be generated at the opposite side of a pouring gate and it is difficult to manufacture a large-sized rotor.

Considering the above problems, a centrifugal casting machine for casting rotors is used. An example of the centrifugal casting machine is disclosed in korean Unexamined Patent Publication No. 2011-0098020.

The centrifugal casting machine disclosed in the patent document includes an upper mold, a lower mold, a fixing part and a turntable.

The turntable is configured to rotate by means of a rotational force transmitted from a motor. The lower mold is fixedly installed on the turntable so as to define a molding space between a core disposed in the fixing part and the lower mold into which a molten metal is introduced to mold an end ring, and the upper mold is installed on an upper end of the fixing part so as to define a second molding space between the core and the upper mold into which a molten metal is introduced to mold an end ring.

At this point, the upper and lower molds are coupled to each other by means of a plurality of bolts with the fixing part disposed therebetween.

According to the conventional centrifugal casting machine, when the upper and lower molds are coupled to each other by means of bolts, silicon steel plates constituting a core are maintained in the close contact condition by pressure transmitted to the core from the upper and lower molds. However, since molding spaces for molding end rings are defined by the upper and lower molds, a pressure is not evenly transmitted to the core thus causing gaps to be partially generated between the silicon steel plates, and introduction of a molten metal into the gaps. In particular, for the upper mold, a pressure is concentrated in the center of the core via trim parts, and thus problems arise due to the creation of gaps between outer regions of the silicon steel plates.

Furthermore, when it is intended to mold rotors which have the same diameter but different lengths, the fixing parts stacked in the core and bolts for coupling the upper and lower molds must be replaced with different ones to construct a centrifugal casting machine having a different configuration, thus making the casting operation very cumbersome.

In addition, in order to take out the rotor in the fixing part after the casting of the rotor is finished, the rotor must be forcibly taken out of the fixing part using an additional device or tool after separation of the upper and lower molds, thus making the removal of cast products difficult.

PRIOR ART DOCUMENT (Patent Document 1) Korean Unexamined Patent Publication No. 10-2011-0098020 (Sep. 1, 2011)

SUMMARY OF THE INVENTION

Accordingly, the present invention has been made keeping in mind the above problems occurring in the prior art, and an object of the present invention is to provide a centrifugal casting machine for casting rotors in which a lower mold disposed under a core is moved up and down by means of a hydraulic ram and in which the hydraulic ram applies a consistent pressure to the lower mold during centrifugal casting of rotors so as to prevent the generation of gaps between silicon steel plates constituting the core.

Another object of the present invention is to provide a centrifugal casting machine for casting rotors which can cast various rotors which have the same diameter but different lengths within an allowable range without replacement of parts.

A still another object of the present invention is to provide a centrifugal casting machine for casting rotors which allows cast products to be easily taken out.

In order to accomplish the above objects and overcome the problems of the prior art, the present invention provides a centrifugal casting machine, including: a rotating plate which rotates by means of a rotational force generated by a motor; a sleeve installed on the rotating plate and having a cylindrical shape having an internal diameter corresponding to an external diameter of a plurality of silicon steel plates constituting a core and stacked in the sleeve; an upper mold internally installed on an upper end of the sleeve to define a first molding space between the upper mold and the core, in which a molten metal is introduced into the first molding space to mold an end ring; a lower mold internally installed on a lower end of the sleeve to define a second molding space between the lower mold and the core, in which a molten metal is introduced into the second molding space to mold an end ring; a dummy shaft fitted in the center of the core and coupled to the lower mold; a cap coupled to an upper end of the dummy shaft to press an upper end of the core; and a hydraulic ram passing through the rotating plate and coupled to the lower mold, the hydraulic ram being moved up and down by a lifting device to move the lower mold up and down and being coupled to the rotating plate to rotate therewith.

The hydraulic ram may be provided on an outer surface thereof with at least one coupling protrusion extending longitudinally, and the rotating plate may include a through-hole through which the hydraulic ram passes and which has at least one groove engaging with the longitudinal protrusion.

The sleeve may be internally provided at an upper end thereof with a seating step on which the upper mold is seated, and the upper mold may be seated on the seating step and coupled to the sleeve by means of at least one key to rotate therewith.

According to the above-described the present invention, since the centrifugal casting machine continuously applies a consistent pressure using the hydraulic ram during a centrifugal casting operation, it is possible to more efficiently suppress the generation of gaps between the silicon steel plates and the introduction of a molten metal into the gaps between the silicon steel plates.

Furthermore, after the casting operation, a cast product can be easily taken out of the sleeve merely by raising the lower mold using the hydraulic ram.

In addition, since a spacing between the upper mold and the lower mold can be freely adjusted by the up-and-down movement of the lower mold, various rotors which have the same diameter but different heights (lengths) within a range allowed by the sleeve can be cast without replacement of parts.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

An exemplary embodiment of the present invention will be described more fully hereinafter with reference to the accompanying drawings. In the following description of the present invention, detailed descriptions of known functions and components incorporated herein will be omitted when it may make the subject matter of the present invention unclear.

Figure 1:
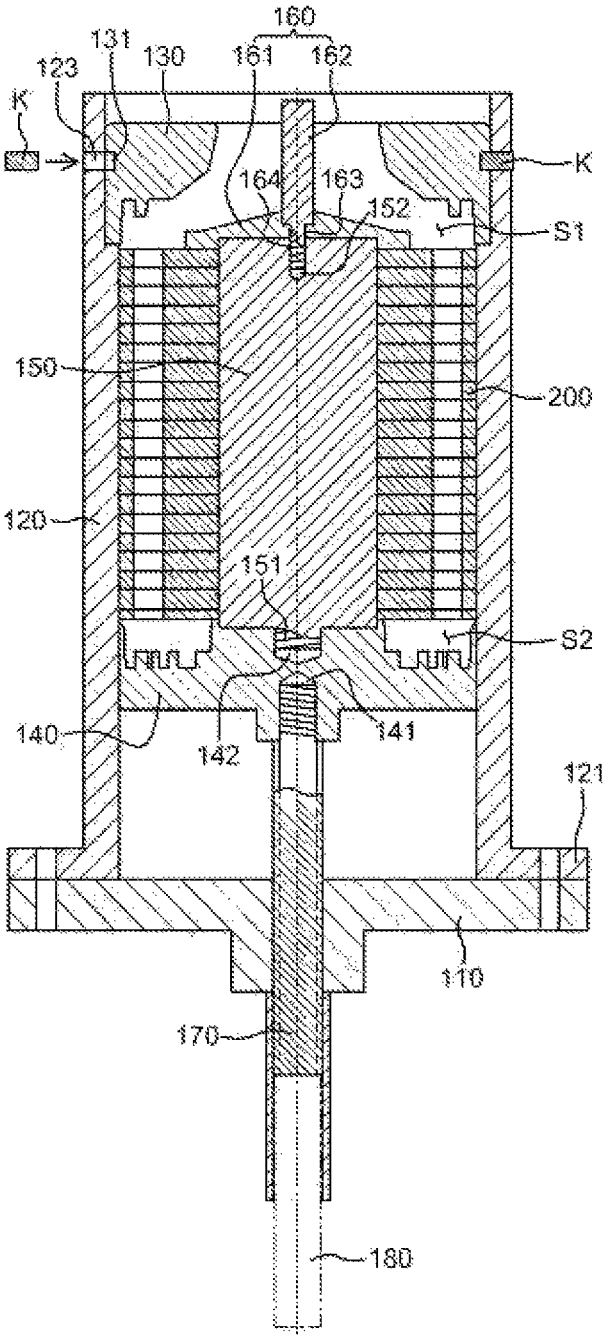
FIG. 1 is a cross-sectional view showing a structure of a centrifugal casting machine according to an embodiment of the present invention.
Figure 2:
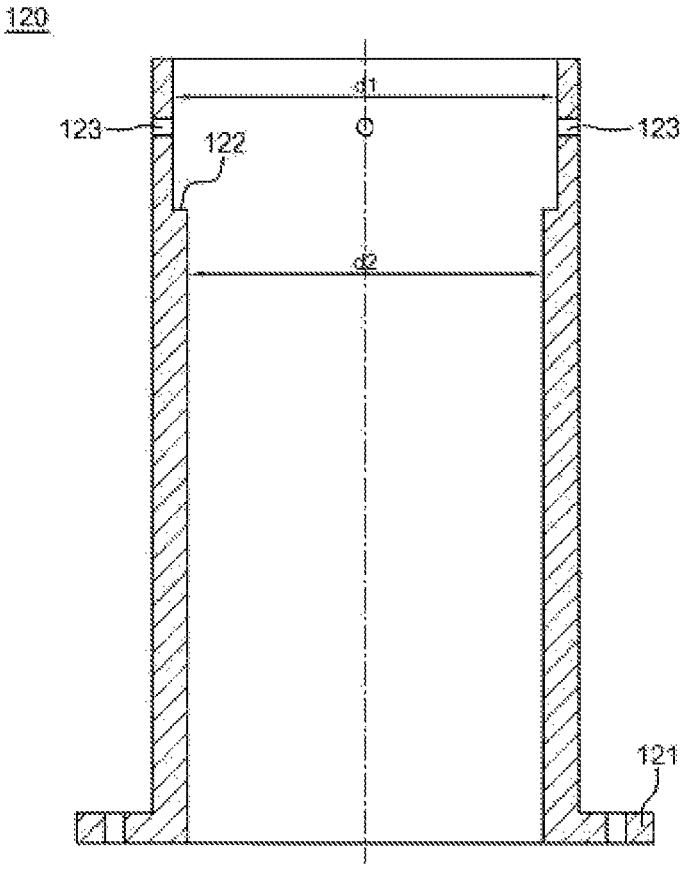
FIG. 2 is a cross-sectional view showing a structure of a sleeve according to an embodiment of the present invention.
Figure 3:
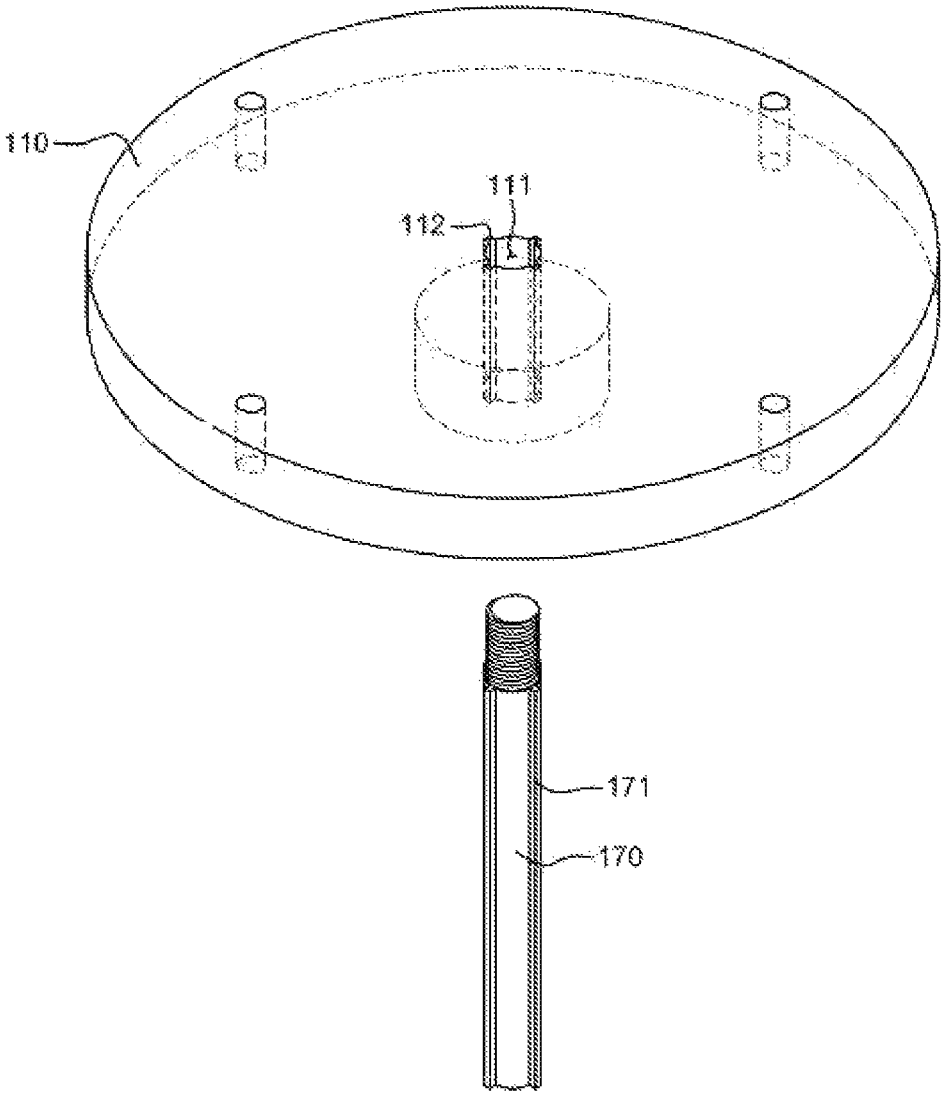
FIG. 3 is a perspective view showing a coupling structure between a rotating plate and a hydraulic ram according to an embodiment of the present invention.

FIG. 1 is a cross-sectional view showing a structure of a centrifugal casting machine according to an embodiment of the present invention, FIG. 2 is a cross-sectional view showing a structure of a sleeve according to an embodiment of the present invention, and FIG. 3 is a perspective view showing a coupling structure between a rotating plate and a hydraulic ram according to an embodiment of the present invention.

The centrifugal casting machine according to an embodiment of the present invention is characterized in that a lower mold disposed below a core 200 is movable by means of a hydraulic ram 170 such that the lower mold 140 can continuously press the core 200 during the casting procedure and the lower mold 140 is raised so as to easily take out a rotor in a sleeve 120 after the casting procedure.

The centrifugal casting machine according to this embodiment of the present, which is made to fulfill the characteristics, comprises a rotating plate 110, a sleeve 120, the lower mold 140, a dummy shaft 150, a cap 160 and the hydraulic ram 170.

The rotating plate 110, which is intended to rotate the centrifugal casting machine, is rotated by being directly connected to a motor (not shown) for generating a rotating force, or by being indirectly connected to the motor via a power transmission component such as a belt or a chain.

The rotating plate 110 is centrally formed with a through-hole 111 through which the hydraulic ram 170 penetrates.

The sleeve 120 is configured to have a cylindrical shape so as to accommodate therein an upper mold 130, the lower mold 140 and the core 200 and to open at the top and bottom thereof. Furthermore, the sleeve 120 is provided at the lower end thereof with a flange 121 which is to be coupled to the rotating plate 110. Of course, the flange 121 is coupled to the rotating plate 110 by means of bolts.

The sleeve 120 is provided at an upper part of an inner surface thereof with an annular seating step 122 on which a lower end of the upper mold 130 is seated. The annular seating step 122 is formed in such a way that an upper part of the inner surface of the sleeve 120 is machined such that an internal diameter (d1) of the upper part of the sleeve 120 is larger than an internal diameter (d2) of the remaining part of the sleeve 120.

Furthermore, a plurality of key holes 123 are formed in the sleeve in order that the upper mold 130 seated on the annular seating step 122 is joined to the sleeve 120 and rotates together therewith and the upper mold 130 in the sleeve 120 is prevented from being separated upward from the sleeve 120. Each of the plurality of key holes 123 penetrates the sleeve 120 from the outer surface to the inner surface.

The upper mold 130 is inserted into the sleeve 120 and is then seated on the annular seating step 122 formed on the sleeve 120 so that a first molding space (S1) into which a molten metal is injected is defined between the core 200 and the upper mold 130 to mold an end ring. Accordingly, the upper mold 130 has the first molding space (S1) in which the a cap 160 is centrally disposed, and is formed on an outer surface thereof with a plurality of key recesses 131 corresponding to the plurality of key holes 123 formed in the sleeve 120.

After the upper mold 130 is inserted into the sleeve 120 and is then seated on the annular seating step 122, the upper mold 130 is positioned such that the plurality of key holes 123 are aligned with the plurality of the key recesses 131, and keys (K) are inserted into the key holes 123 and is then engaged with the key recesses 131. As a result, the upper mold 130 rotates at the same speed as that of the sleeve 120.

The lower mold 140 is disposed below the core 200 in the sleeve 120, thus defining a second molding space (S2) into which molten metal is injected to mold an end ring.

A first coupling hole 141 with which the hydraulic ram 170 is engaged is centrally formed in a lower surface of the lower mold 140, and a second coupling hole 142, with which the dummy shaft 150 is engaged, is centrally formed in an upper surface of the lower mold 140. For reference, each of the first coupling hole 141 and the second coupling hole 142 is composed of a tap hole which is provided on an inner surface thereof with an internal thread. The internal thread is a right-hand thread or a left-hand thread such that the hydraulic ram 170 and the dummy shaft 150 are rotated in the direction opposite the rotational direction of the centrifugal casting machine when the hydraulic ram 170 and the dummy shaft 150 are coupled to the lower mold 140.

The dummy shaft 150, which has a circular section, is centrally disposed in the core 200 which is composed of a plurality of silicon steel plates which are stacked in the sleeve 120 so as to support the core 200 and to prevent a molten metal from being introduced into the center of the core 200.

The dummy shaft 150 includes a screw protrusion 151 formed on the lower end thereof for the screw coupling to the lower mold 140.

The cap 160, which is coupled to the top of the dummy shaft 150 to press the upper end of the core 200, is composed of a cover 161 and a fixture 162.

The cover 161 is a disc-shaped plate which is centrally provided with a through-hole 163 protruding downward, and is coupled to the dummy shaft 150 to press an upper end of the core 200.

The fixture 162 is coupled to the dummy shaft 150 through the through-hole 163 formed in the cover 161 to fix the cover 161 to the dummy shaft 150. The fixture 162 is provided at a lower end thereof with an external thread 164, and an internal thread 152 which engages with the external thread 164 formed on the lower end of the fixture 162 is formed on the upper end of the dummy shaft 150.

The hydraulic ram 170 is coupled to the lower mold 140 to move the lower mold 140 up and down. The hydraulic ram 170 passes through the rotating plate 110 and then the upper end of the hydraulic ram 170 engages with the first coupling hole 141 formed in the bottom of the lower mold 140.

The hydraulic ram 170 is raised or lowered by means of an additional lifting device 180 to move the lower mold 140 up and down.

For reference, the lifting device 180 may be composed of a hydraulic cylinder, or may be composed of a conversion mechanism such as a rack and a pinion for converting a rotational motion into a linear motion. The lifting device 180 is disposed directly under the hydraulic ram 170, and is coupled to the hydraulic ram 170 to rotate therewith, or is separated from the hydraulic ram 170 to maintain its fixed position regardless of the rotation of the hydraulic ram 170.

When the hydraulic ram 170 is separated from the lifting device 180 as in the latter case, the hydraulic ram 170 is raised upward by the upward motion of the lifting device 180 thus raising the lower mold 140. In contrast, when the lifting device 180 is lowered, the lower mold 140 and the hydraulic ram 170 are also lowered by their weights.

The hydraulic ram 170 is coupled to the rotating plate 110 and is thus rotated therewith so as to rotate the lower mold 140 disposed in the sleeve 120 together with the sleeve at the same rotational speed.

More specifically, the hydraulic ram 170 which passes through the rotating plate 110 is movable up and down and rotates together with the rotating plate 110. To this end, the hydraulic ram 170 has a cylindrical shape and includes at least one coupling protrusion 171 which extends longitudinally. A groove 112 which engages with the longitudinal protrusion 171 is formed on the through-hole 111 of the rotating plate 110.

In the above configuration, the hydraulic ram 170 passes through the through-hole 111 and is freely movable up and down. The hydraulic ram 170 rotates together with the rotating plate 110 at the same rotational speed thus rotating the lower mold 140.

An operation of centrifugally casting a rotor of a rotating appliance using the centrifugal casting machine according to the present invention will now be described. By the description of the operation, functions and effects of the centrifugal casting machine according to the present invention will be apparent.

In order to cast a rotor using the centrifugal casting machine according to the present invention, a plurality of silicon steel plates are first stacked over the dummy shaft 150. Although being not specifically illustrated in the drawings, since a small flange protrudes from the lower end of the dummy shaft 150, the silicon steel plates stacked over the dummy shaft 150 cannot escape from the dummy shaft 150 downward.

After the silicon steel plates are stacked over the dummy shaft 150 by the above procedure, the cover 161 is placed on the upper end of the dummy shaft 150, and the fixture 162 passes through the cover 161 and is coupled to the dummy shaft 150 with the result that the dummy shaft 150 and the dummy shaft 160 are assembled into a single assembly.

The sleeve 120 in which the assembly is to be disposed is fixed to the rotating plate 110, and the lower mold 140 is coupled to the hydraulic ram 170.

Thereafter, the screw protrusion 151 provided on the lower end of the dummy shaft 150 engages with the second coupling hole 142 formed in the lower mold 140, thus assembling the assembly with the lower mold 140.

Subsequently, the hydraulic ram 170 is lowered, and the lower mold 140, the cap 160, the dummy shaft 150 and the silicon steep steel plates are inserted in the sleeve 120.

The upper mold 130 is seated on the annular seating step 122 formed on the sleeve 120, and the upper mold 130 is positioned such that the key recesses 131 formed on the upper mold 130 is aligned with the key holes 123 formed in the sleeve 120. Thereafter, the key (K) is fitted in the key hole 123 thus coupling the upper mold 130 to the sleeve 120.

The hydraulic ram 170 is raised by the lifting device 180 so that the core 200 is pressed by the lower mold 140. The upward motion of the hydraulic ram 170 causes the core 200 to be pressed, and the lower mold 140 continuously press the core at a certain pressure, thus preventing the generation of gaps between the silicon steel plates and the introduction of a molten metal into the gaps between the silicon steel plates.

By this procedure, the preparation for the centrifugal casting of a rotor is finished. Thereafter, a molten metal is introduced through the upper mold 130 while the rotating plate 110 rotates. The molten metal introduced in the upper mold 130 flows into the lower mold 140 through holes formed in the core 200 thus casting the rotor.

When the rotating plate 110 rotates, the hydraulic ram 170 rotates at the same rotational speed as that of the rotating plate 110 thus rotating the lower mold 140. At this point, since the upper mold 130 is secured to the sleeve 120 by means of the key (K), the upper mold 130 rotates at the same rotational speed as that of the sleeve 120. Consequently, the upper mold 130 and the lower mold 140 can rotate at the same rotational speed even though the upper mold 130 and the lower mold 140 are directly coupled to each other, whereby a uniform centrifugal force is applied throughout upper and lower parts of the rotor thus enhancing a casting quality.

When the casting of the rotor is finished through the above operation, the key (K) which is used to couple the upper mold 130 to the sleeve 120 is removed, and the upper mold 130 is separated from the sleeve 120.

Subsequently, the lower mold 140 is raised by the lifting device 180, and thus the rotor is also raised and taken out of the sleeve 120 by the upward motion of the lower mold 140.

As a result, the entire operation of casting the rotor by the centrifugal casting machine is finished. An upper end ring formed on an upper end of the rotor taken out of the sleeve 120 is machined to remove unnecessary portions, and the cap 160 and the dummy shaft 150 are separated from the rotor.

As described above, since the centrifugal casting machine according to the present invention continuously applies a consistent pressure using the hydraulic ram 170 during a centrifugal casting operation, it is possible to more efficiently suppress generation of gaps between the silicon steel plates and introduction of a molten metal into the gaps between the silicon steel plates.

Furthermore, after the casting operation, a cast product can be easily taken out of the sleeve 120 merely by raising the lower mold 140 using the hydraulic ram 170.

In addition, since a spacing between the upper mold 130 and the lower mold 140 can be freely adjusted by the up-and-down movement of the lower mold 140, various rotors which have the same diameter but different lengths within a range allowed by the sleeve 120 can be cast without replacement of parts.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A centrifugal casting machine, comprising:

a rotating plate having a through-hole formed in a central portion thereof and configured to rotate by means of a rotational force;

a sleeve installed on the rotating plate and having a hollow cylindrical shape, wherein an internal diameter of the sleeve corresponds to an external diameter of a core stacked inside the sleeve;

an upper mold disposed inside the sleeve such that an outer circumferential surface of the upper mold is in contact with an inner circumferential surface of the sleeve, the upper mold defining a first molding space between the upper mold and the core, to mold an upper end ring;

a lower mold disposed inside the sleeve and slidingly moving along the inner circumferential surface of the sleeve, the lower mold defining a second molding space between the lower mold and the core to mold a lower end ring;

a dummy shaft coupled to a top side of the lower mold to support the core and prevent a molten metal from being introduced into a center of the core;

a cap coupled to a top end of the dummy shaft to press the core from a top; and a hydraulic ram slidingly inserted into the through-hole of the rotating plate, a top end of the hydraulic ram being coupled to a bottom side of the lower mold and a bottom end of the hydraulic ram being coupled to a lifting device such that the hydraulic ram moves up and down by the lifting device, thereby the lower mold moving up and down relatively to the rotating plate.

2. The centrifugal casting machine according to claim 1, wherein the hydraulic ram includes at least one coupling protrusion formed on an outer surface thereof and extending along a longitudinal direction of the hydraulic ram, and the through-hole of the rotating plate includes at least one groove with which the longitudinal protrusion engages.

3. The centrifugal casting machine according to claim 1, wherein the sleeve has a seating step formed inside an upper portion of the sleeve, on which the upper mold is seated, the seating step having a diameter greater than the internal diameter of the sleeve, and the sleeve has at least one key hole formed in the seating step to fix the upper mold to the sleeve by a key.

4. The centrifugal casting machine according to claim 1, wherein the lower mold includes a first coupling hole formed in a center portion of the bottom side thereof, to which the top end of the hydraulic ram is engaged, and a second coupling hole formed in a center portion of the top side thereof, to which the bottom end of the dummy shaft is engaged.

5. The centrifugal casting machine according to claim 1, wherein the sleeve further includes a flange outwardly protruding from a bottom end thereof to install the sleeve to the rotating plate by means of bolts.

* * * * *